United States Patent [19]

Allemann

[11] 4,109,494

[45] Aug. 29, 1978

[54] SIMULTANEOUS RETRACT MECHANISM

[75] Inventor: James G. Allemann, Santa Ana, Calif.

[73] Assignee: Norris Industries, South Gate, Calif.

[21] Appl. No.: 802,042

[22] Filed: May 31, 1977

[51] Int. Cl.[2] ..... E05B 59/00

[52] U.S. Cl. ..... 70/107; 292/38

[58] Field of Search ..... 70/107–111; 292/38, 50, 141, 171

[56] References Cited

U.S. PATENT DOCUMENTS

| | | | |
|---|---|---|---|
| 2,541,723 | 2/1951 | Shaw et al. | 292/171 X |
| 3,791,180 | 2/1974 | Doyle | 292/34 X |
| 3,875,772 | 4/1975 | Ebersman et al. | 292/38 X |

FOREIGN PATENT DOCUMENTS

| | | | |
|---|---|---|---|
| 1,506,938 | 11/1967 | France | 292/171 |

*Primary Examiner*—Roy D. Frazier
*Assistant Examiner*—William E. Lyddane

[57] ABSTRACT

The invention involves a mechanism for simultaneously retracting two separate latch bolts which have previously been extended by their individual separate mechanisms. The individual mechanisms comprise a substantially conventional knob actuated latch bolt, and what is commonly called a locking dead bolt. There is a lever arm attached to the knob spindle and a bell crank arm on a thumb turn shaft of the dead bolt. A flexible strip anchored at one end to the free end of the lever arm projects slidably through a swivelling sleeve on the free end of the bell crank. By providing a stop at the extremity of the strip by rotation of the knob spindle and its lever arm the bell crank is induced to rotate and withdraw the dead bolt to unlocked position, at the same time that the latch bolt is withdrawn to open the door. Conversely, when the dead bolt only is withdrawn, by rotation of the thumb turn shaft merely to unlock the door, the strip will slide through the swivelling sleeve. The lever arm of the knob spindle remains undisturbed and the latch bolt, therefore, remains in extended position, holding the door closed until withdrawn by knob action.

8 Claims, 12 Drawing Figures

SIMULTANEOUS RETRACT MECHANISM

Lock sets incorporating an upper dead bolt trim and a lower knob trim are usually sectional. This means that both of these trims are entirely independent, one from another, unconnected to each other, and function independently. As a consequence, when a door provided with two trims of the kind made reference to is to be opened, particularly from the inside, the person desiring egress must unlock the dead bolt of the upper trim and then actuate the knob of the lower trim. This constitutes a two-hand operation or, in the alternative, a one-hand twice type operation, which at best is inconvenient. On those occasions where attempts have been made to connect together the two trims with a mechanical mechanism capable of retracting the dead bolt simultaneously with rotation of the knob trim, such mechanisms have consisted of, on some occasions, a series of levers and bell cranks and dependence on an unnecessarily large number of parts. On other occasions, gear trains have been employed to interconnect the two trims, combined, on occasions, with levers or bell cranks. Although functionally effective, hard mechanical drive trains of the type heretofore employed require complex precision components and tight locational tolerances, and these requirements affect the functional reliability and also the production cost.

Of prime importance in providing a simultaneous retract mechanism is the ease with which it can be converted for change of door hands. To change door hands in the hard mechanical drive type, it is usually necessary to disassemble the unit, remove the parts, and install or reverse one or more of the components. This is a disadvantage in addition to the cost and complexity of initial assembly and installation.

It is also of importance in connecting together two trims of the type made reference to that the knob be capable of rotation in either direction, while at the same time withdrawing the dead bolt of the upper trim.

It is, therefore, among the objects of the invention to provide a new and improved simultaneous retract mechanism for a dead bolt and knob, which is simple in construction so that it can be made inexpensively and installed without serious problems by persons of no more than modest mechanical skill.

Another object of the invention is to provide a new and improved simultaneous retract mechanism for interconnecting a dead bolt and knob action which has a substantial minimum number of components.

Still another object of the invention is to provide a new and improved simultaneous retract mechanism for interconnecting dead bolt and knob mechanisms, which by reason of its simplicity can be constructed inexpensively without sacrifice of functional dependability.

Still another object of the invention is to provide a new and improved simultaneous retract mechanism for interconnection dead bolt and knob actuators which permits the mechanism to be changed readily from a right-hand installation to a left-hand installation.

Still further among the objects of the invention is to provide a new and improved simultaneous retract mechanism for interconnecting dead bolt and knob actuators which is fail safe to the extent that nothing will impair operation of either the dead bolt or the knob separately, especially under circumstances where there may be appreciable need for haste in opening a locked door.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

Figure 1:
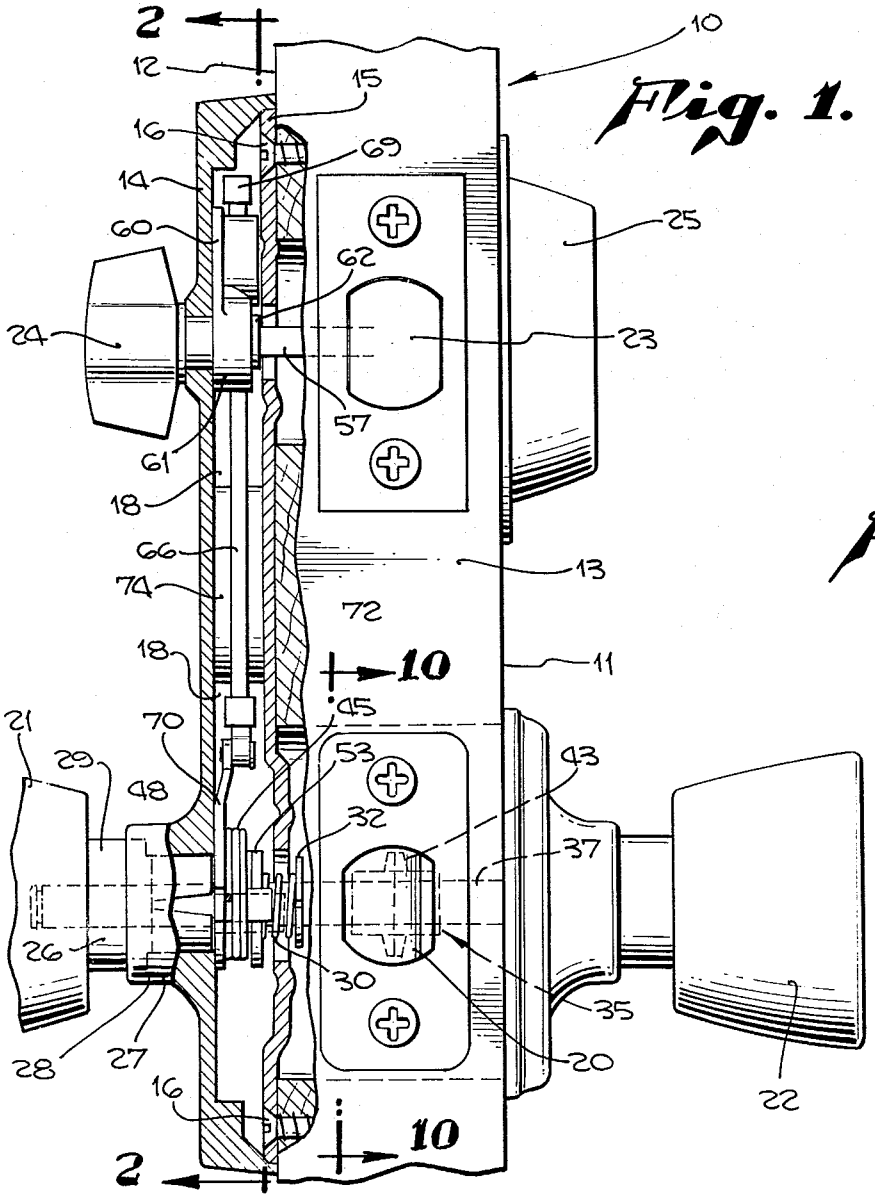
FIG. 1 is a fragmentary end elevational view of a section of door showing the simultaneous retract mechanism in vertical section applied to it.

In an embodiment of the invention chosen for the purpose of illustration, there is shown a door indicated generally by the reference character 10, having an outside face 11, an inside face 12 and an edge face 13. Purely by way of example, the mechanism is initially described as set up for a right-hand mounting inside swing as shown diagrammatically in FIG. 5, the parts having the orientation as depicted in FIG. 1 and related figures.

The mechanism is contained within an escutcheon 14, behind which is a mounting plate 15, to which the escutcheon is secured in a conventional fashion. The mounting plate in turn is secured to the door in the embodiment shown by screws 16. Between the escutcheon 14 and the mounting plate 15 is a chamber 18 where the mechanism resides (see FIGS. 1 and 3).

A latch bolt member 20 is adapted to be manipulated either by an inside knob 21 or an outside knob 22. A dead bolt member 23 is adapted to be manipulated in the alternative either by a thumb turn 24 on the inside face of the door, or by a key actuated mechanism (not shown) to which access is had through an appropriate key trim 25 on the outside face 11 of the door. The simultaneous retract mechanism here under consideration is designed to interconnect manipulation of the latch bolt member 20 and dead bolt member 23.

Figure 10:
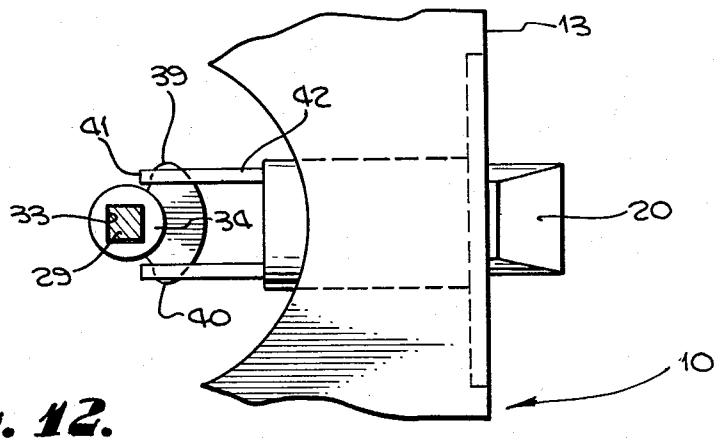
FIG. 10 is a fragmentary vertical sectional view on the Line 10—10 of FIG. 1.
Figure 11:
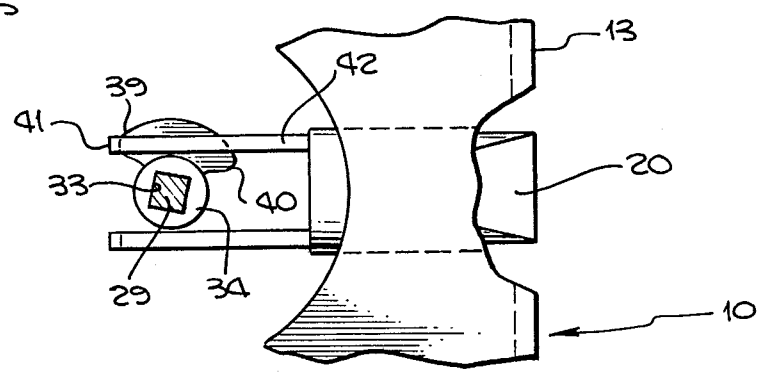
FIG. 11 is a fragmentary vertical sectional view similar to FIG. 10, but showing the dead bolt withdrawn.
Figure 12:
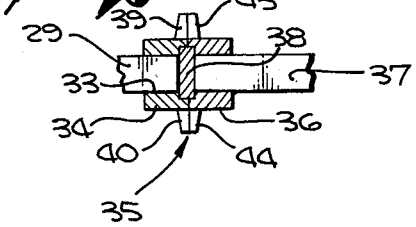
FIG. 12 is a fragmentary cross-sectional view showing the junction of outer and inner latch bolt spindles.
Figure 9:
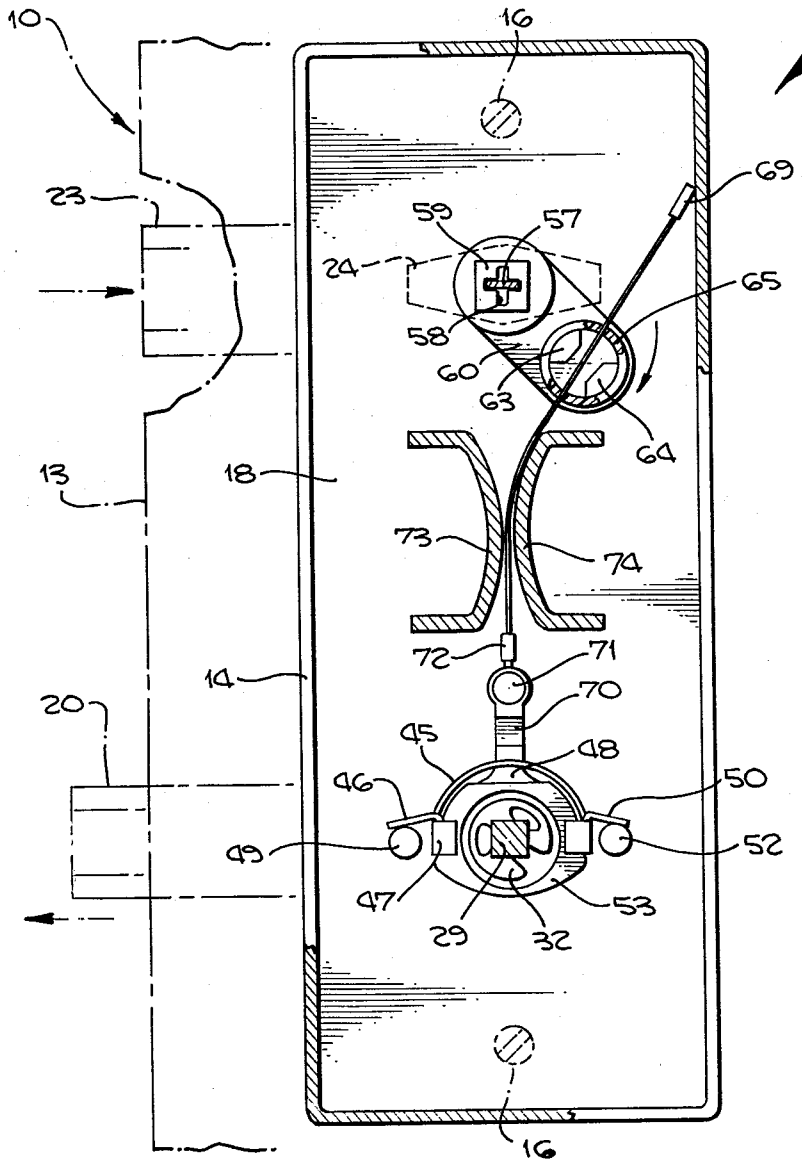
FIG. 9 is a view similar to FIGS. 4 and 6, but showing the dead bolt withdrawn and the knob latch bolt extended.

The knob 21, provided with a knob shank 26 is rotatably mounted in a bushing 27 forming part of the escutcheon 16, by means of a low friction insert 28. Extending from the inside knob 21, is a square spindle 29. A spring 30 confined between a relatively stationary retaining ring 31 on the left and a retaining ring 32 on the right, secured to the square spindle 29 (see FIG. 3), is biased to urge the square spindle into a complementary square recess 33 of section 34 of a split hub 35 (see FIGS. 10, 11 and 12). The other section 36 of the split hub 35 receives a spindle 37 from the outside knob 22, the spindles 37 and 29. being separated by a freely rotating disc 38. Ears 39 and 40 of the section 34 operate against one or another of the roll backs 41 of a shaft 42 forming part of the latch bolt member 20. Ears 43 and 44 on the section 36 likewise act on the same roll back 41. The split hub serves to permit the latch bolt member to be withdrawn independently either by the inside knob 21 or the outside knob 22. Any activity of the spindle 37 cannot, therefore, be carried over to the simultaneous retract mechanism. Also, there is no occasion for any need of synchronization between the outside and inside knobs.

For holding the inside knob 21 normally in the position of FIGS. 1, 2, 9 and 10, for example, with the latch bolt 20 extended, there is provided a torsion spring 45. One end 46 of the torsion spring is pressed against a tab 47 of a washer 48, which overlies the torsion spring. The same end 46 is adapted to stop against a stationary post 49. The other end 50 of the torsion spring is adapted to bear against a tab 51 of the washer 48 and to stop also against a similar stationary post 52. Clearly, therefore, for either clockwise or counterclockwise rotation, the torsion spring 45 will return the washer to the normal position of FIGS. 1, 2 and 9 and, since the washer 48 is non-rotatably mounted upon the spindle 29, the spindle will likewise be returned to the same position. A flanged washer 53 and its flange 54 accommodate the torsion spring 45.

Figure 3:
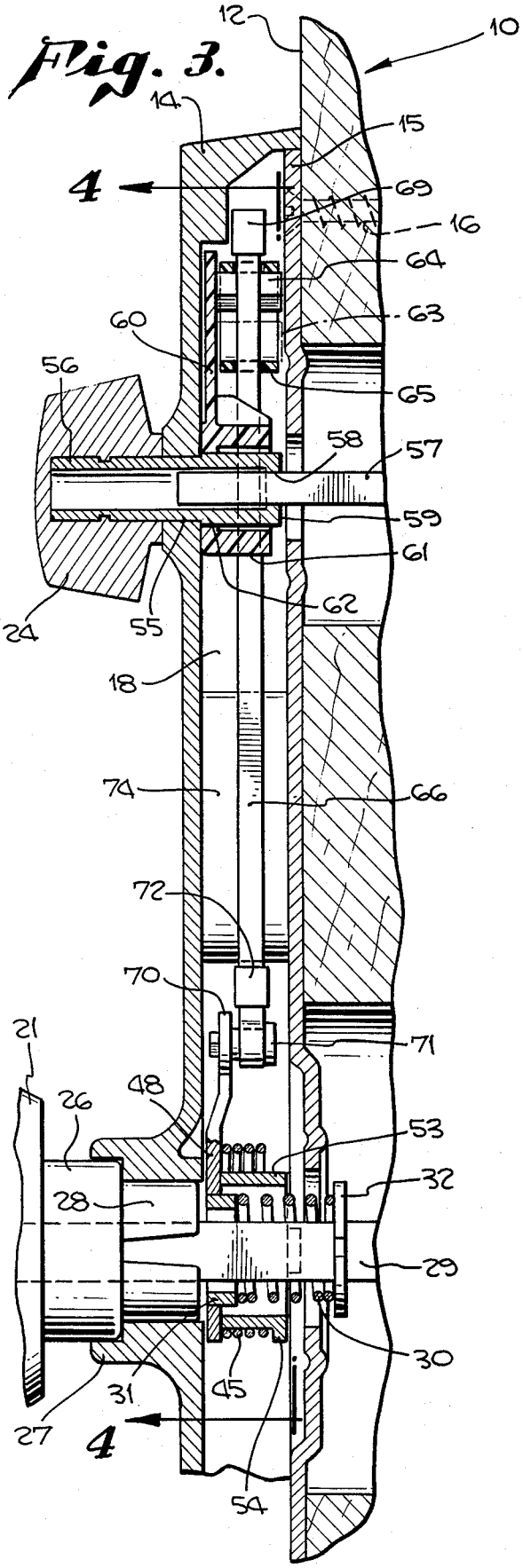
FIG. 3 is a fragmentary vertical sectional view on the Line 3—3 of FIG. 2.

For manipulating the dead bolt member 23 by either the thumb turn 24 or a key operated mechanism from the key trim 25, there is provided a shaft 55 which has an end 56 press fit in the thumb turn 24 as shown in FIG. 3. The shaft is tubular and receives in it a relatively flat tail piece 57 from the key trim 25, the tail piece being slidably and non-rotatably received in one portion of a milled cross slot 58 in an end face 59 of the shaft 55. Details of the dead bolt member roll back have been omitted inasmuch as they are of conventional construction.

To facilitate the simultaneous manipulation of the dead bolt member 23, when the latch bolt member is operated, and at the same time avoid manipulation of the latch bolt member when the dead bolt member is to be operated separately, there is a special interconnection between the two. For the shaft 55 there is provided a bell crank 60 for the thumb turn, which has a bushing 61 non-rotatably mounted on a squared portion 62 of the shaft 55. Near the outer end of the bell crank 60 are pivot segments 63, 64. A sleeve 65 fits over and is carried by the pivot segments.

A connector 66, which in the present example is a resilient metallic band, extends through the sleeve 65, traversing diametrically line slits 67 and 68. At the outer end of the connector 66 there is applied a swaged sleeve 69.

The other end of the connector 66 is attached to an arm 70, the arm actually being a radial extension of the washer 48 which may be designated a return washer. The attachment for the connector consists of pivot pin 71 on the arm 70, around which the end of the connector is swivelly secured by a swaged sleeve 72. A pair of guides 73, 74 may be cast integrally or otherwise attached to the escutcheon 14 in position providing a space between curved surfaces of the guides through which the connector 66 can freely slide.

Figure 2:
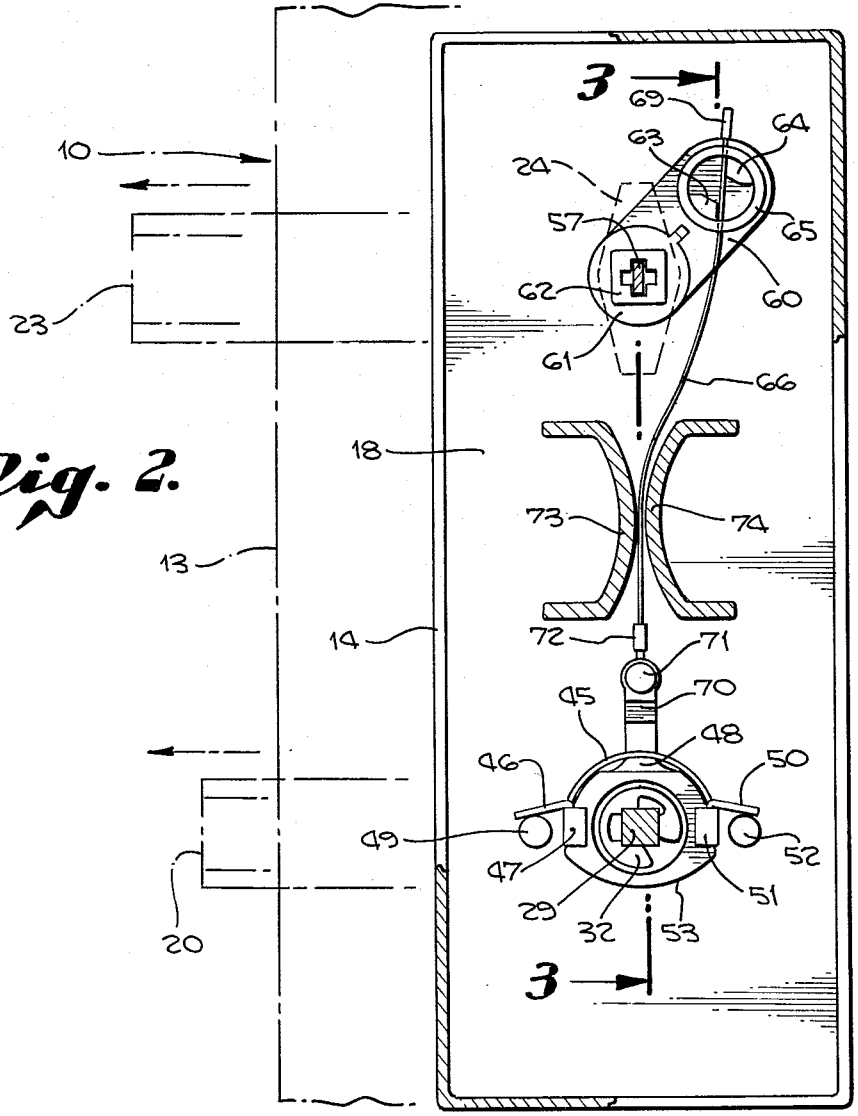
FIG. 2 is a vertical sectional view on the Line 2—2 of FIG. 1.
Figure 4:
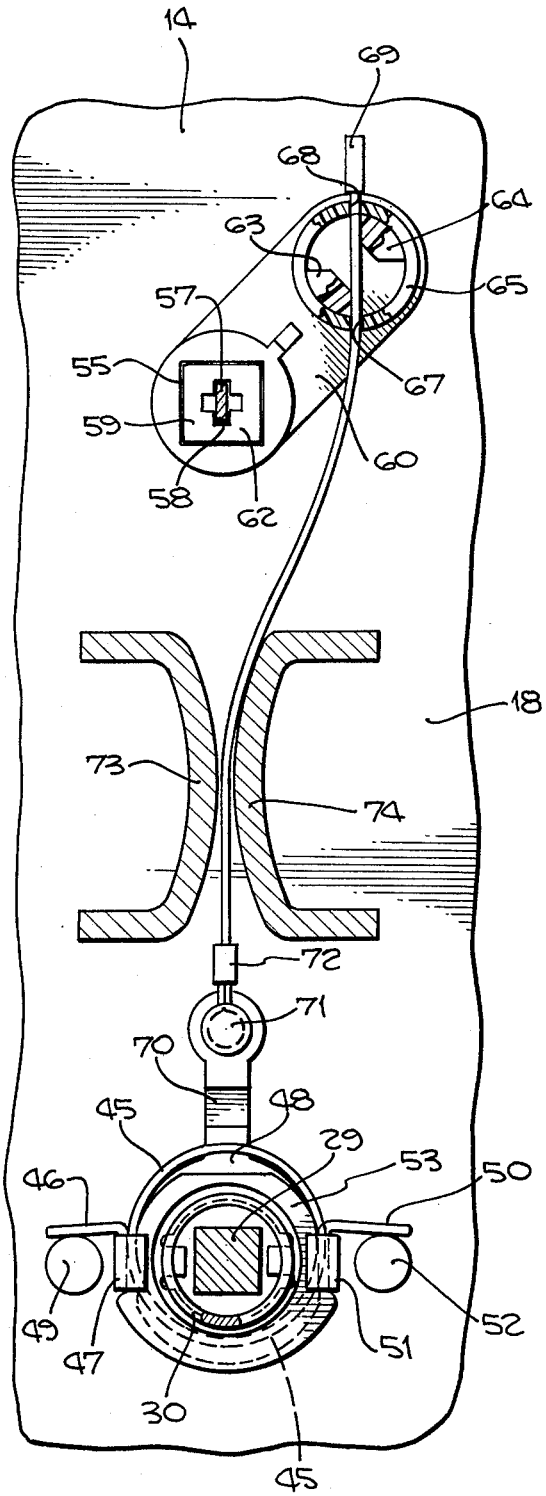
FIG. 4 is a vertical sectional view on the Line 4—4 of FIG. 3.
Figure 6:
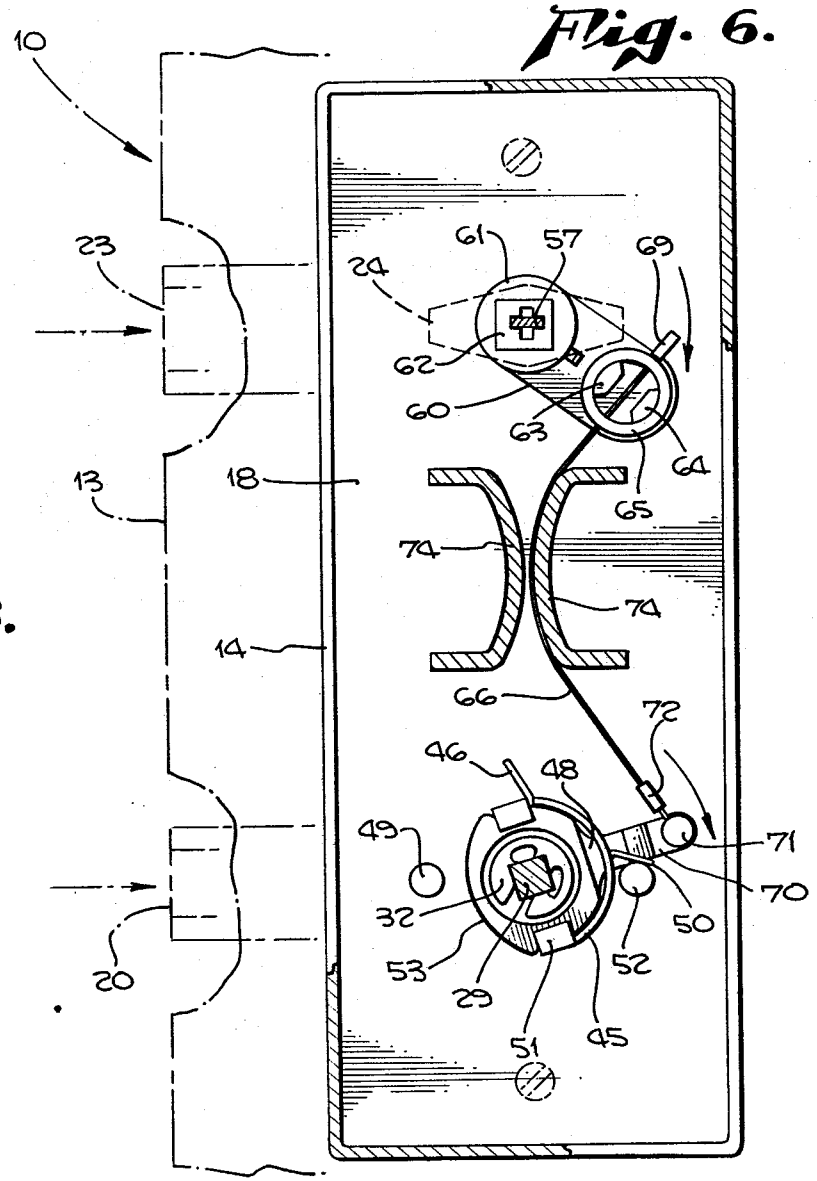
FIG. 6 is a view similar to FIG. 4, but with both latch bolts withdrawn.

In operation let it be assumed that both the latch bolt member 20 and the dead bolt member 23 are extended to latched or locked positions as shown in FIG. 2, and that it is the desire of the operator by manipulation only of the inside knob 21 to withdraw both bolts. The operator, in grasping the knob 21, rotates it in either direction. For purposes of illustration, let it be assumed that the rotation is in a counterclockwise direction as viewed from inside the door, or in a clockwise direction from the position of FIG. 2 to the position of FIG. 6. The rotation of the knob and its spindle 20 serve to rotate the washer 48 and the arm 70, at the same time as the spindle 29 by rotating the section 34 of the split hub 35, acts to withdraw the latch bolt member 20. At the same time, the arm 70 pulls the connector 66 downwardly. When the swaged sleeve 69 pulls downwardly on the end of the bell crank 60, as it will do because the swaged sleeve cannot be pulled through the slit 68, the bell crank is caused to rotate from the position of FIGS. 2 and 4, for example, to the position of FIG. 6. Rotation of the bell crank through the arc indicated is sufficient to withdraw the dead bolt member 23. When the knob 21 is then released, energy stored up in the torsion spring 45 wherein one end 50 is stopped against the stationary post 52 and the other end 46 acts against the tab 47, causes the washer 48 to rotate in a clockwise direction as viewed from inside the door, or in a counterclockwise direction from the position of FIG. 6 to the position of FIG. 9, which is initial position. During this movement, the connector 66 is pushed upwardly through the space between the guides 73 and 74. At the same time the connector slides through the slits 67, 68, where it is permitted to slide freely. Accordingly, return of the washer 48 to normal position will have no effect upon the position of the bell crank 60. Therefore, the dead lock member will remain in withdrawn position. When the dead lock member is to be extended to lock position, this must be accomplished either by the thumb turn 24 on the inside of the door or by manipulation of a key in the key trim 25 on the outside of the door. When the dead bolt is returned to extended or locked position, the bell crank 60 is rotated in a counterclockwise direction from the position of FIG. 9 to the position of FIG. 4. During this movement the slits 67 and 68 slide over a corresponding portion of the connector 66 which offers no impediment to movement of the bell crank, and accordingly no impediment to extension of the dead bolt to locked position.

Should the operator wish to withdraw the dead bolt without necessarily manipulating the latch bolt, this can be done by either rotating the thumb turn 24 or by a key action. The result is a rotation of the bell crank 60 counterclockwise from the position of FIG. 4 to the position of FIG. 9. This is accomplished without any impediment on the part of the connector 66, which again slides freely through the slits 67, 68. Clearly, by this operation, the dead bolt member is withdrawn without it being necessary to disturb the extended position of the latch bolt member.

Figure 5:
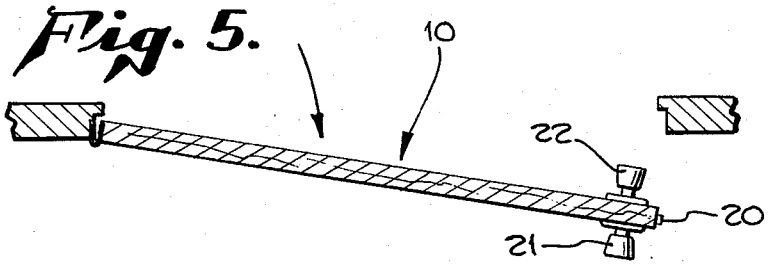
FIG. 5 is a right-hand mounting for the mechanism, in the arrangement of FIG. 1.
Figure 7:
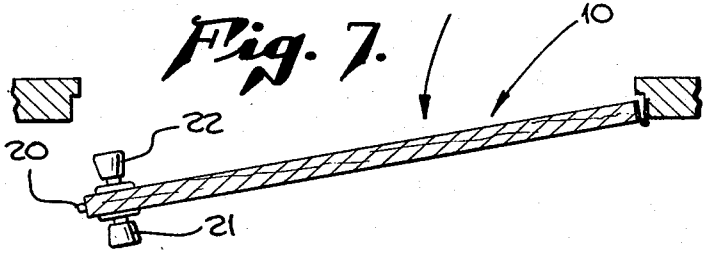
FIG. 7 shows the swing of the door with the mechanism mounted on the left-hand side.
Figure 8:
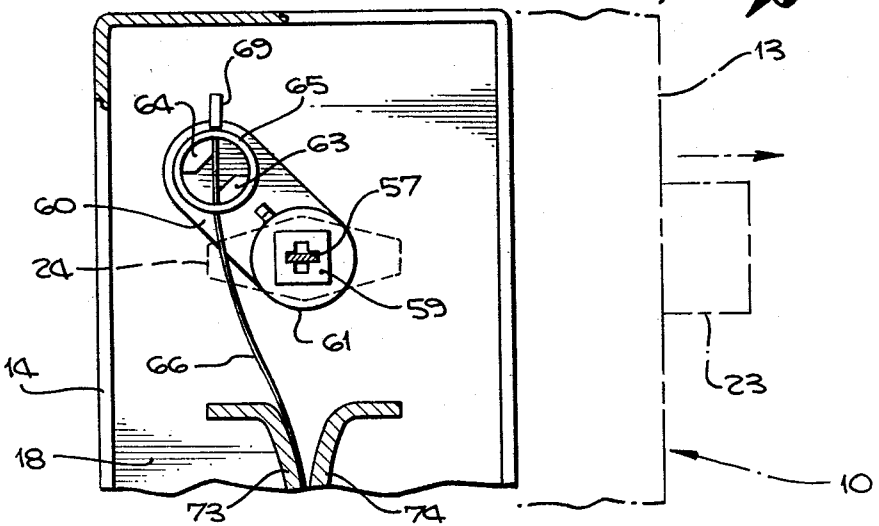
FIG. 8 is a fragmentary sectional view of the bell crank and the orientation it would have for the left-hand mounting of FIG. 7.

When the door hand is to be changed, that is to say, when the latch bolt member and dead bolt member are to be mounted on the left-hand side of the door as viewed in FIG. 7, instead of on the right-hand side as viewed in FIG. 5, very little change is needed in the simultaneous retract mechanism. All that is necessary is to disengage the sleeve 65 from the bell crank pivot segments 63 and 64, rotate the bell crank 60 to the position of FIG. 8, namely at an angular distance of 90°, and then reposition the sleeve 65 on the pivot segments. In this position the thumb turn 24 is rotated in the opposite direction to extend the dead bolt member. All other functions operate as usual in the same manner as heretofore described. Rotation of the inside knob 21 in either direction working through the arm 70 and connector 66 serves to rotate the bell crank 60 in a counterclockwise direction as viewed in FIG. 8, at the same time as rotation of the knob 21 in either direction occurs. During this rotation, the dead lock member is withdrawn as is also the latch bolt member. Return operation occurs in the same fashion as has already been described.

By reason of the relatively narrow distance between the escutcheon 14 and the mounting plate 15, their proximity is sufficient to be relied upon to hold, for example, the sleeve 65 in its position of the bell crank 60. Also by reason of this proximity, the connector 66 is adequately confined.

From the foregoing explanation it will be readily apparent that the retract mechanism for simultaneous withdrawing the dead bolt when the latch bolt is withdrawn is relatively simple and comprises virtually a minimum number of parts. Close tolerances are not necessary and no synchronizing of operation is needed. The parts slide easily into position and once the escutcheon is fastened into position on the mounting plate, all of the parts are by this operation securely confined in their operative positions. Should there by any occasion to change the hand of the door, or actually to set the mechanism initially in position on one side of the door or the other, no alteration or positioning of the parts is needed, other than the simple expedient of shifting the position of the sleeve 65.

Having described the invention, what is claimed as new in support of Letters Patent is as follows:

1. In a locking device for a door comprising a knob and spindle actuator for a latch bolt for shifting said latch bolt between latched extended and unlatched withdrawn positions, and a dead bolt shaft for a dead bolt lock assembly for shifting a dead bolt between a locked extended position and an unlocked withdrawn position, a linkage comprising a lever arm having a captive end nonrotatably attached to the spindle, a bell crank arm having a captive end nonrotatably attached to the dead bolt shaft and a connector between said bell crank arm and said lever arm, said connector comprising a single flexible member having a fixed attachment to the free end of one of said arms and a second attachment to the free end of the other of said arms, said second attachment being movable endwise relative to said free end of the other of said arms in one direction and immovable endwise relative to said free end of the other of said arms in the other direction whereby the bell crank arm is rotated in response to the action of the lever arm and the lever arm remains undisturbed by rotation of the bell crank arm.

2. In a locking device as in claim 1, the second attachment comprising a sleeve rotatably mounted on the corresponding arm and an opening extending transversely through the sleeve, said flexible member extending into said opening and being movable relative to said opening.

3. In a locking device as in claim 2, the second attachment being on the bell crank arm and the fixed attachment being rotatable at a fixed location on said lever arm.

4. In a locking device as in claim 1, a guide intermediate said attachments having a passageway therethrough, said flexible member having a guided sliding movement through said passageway.

5. In a locking device as in claim 1, said flexible member comprising a flat resilient element.

6. In a locking device as in claim 1, said lever arm on the spindle being rotatable in either direction, and said bell crank arm being responsive to rotation of said lever arm in either direction whereby to simultaneously withdraw said dead bolt.

7. In a locking device as in claim 1, a spring return for said spindle acting in both rotational directions for return of the latch bolt to latched position and return of said single flexible member to initial position.

8. In a locking device for a door comprising a knob and spindle actuator for a latch bolt for shifting said latch bolt between latched extended and unlatched withdrawn positions, and a dead bolt shaft for a dead bolt lock assembly for shifting a dead bolt between a locked extended position and an unlocked withdrawn position, a linkage comprising a lever arm having a captive end nonrotatably attached to the spindle, a bell crank arm having a captive end nonrotatably attached to the dead bolt shaft and a connector between said bell crank arm and said lever arm, said connector comprising a flexible member having a fixed attachment to the free end of one of said arms and an attachment to the free end of the other of said arms, said last identified attachment being movable endwise in one direction and immovable endwise in the other direction whereby the bell crank arm is rotated in response to the action of the lever arm and the lever arm remains undisturbed by rotation of the bell crank arm, said flexible member being a flat resilient element, the fixed attachment being in a pivot on one of said arms with a loop of said resilient element being loosely secured around said pivot, a transverse opening through the free end of the other of said arms, and a swage block on the end of said flat resilient element adjacent the last identified arm having a size too big to pass through said transverse opening.

* * * * *